US006398516B1

(12) United States Patent
Kawaguchi et al.

(10) Patent No.: US 6,398,516 B1
(45) Date of Patent: Jun. 4, 2002

(54) VARIABLE DISPLACEMENT COMPRESSORS AND CONTROL VALVES FOR VARIABLE DISPLACEMENT COMPRESSORS

(75) Inventors: Masahiro Kawaguchi, Kariya; Takuya Kudo, Fujisawa; Norio Uemura, Fujisawa; Kouji Watanabe, Fujisawa; Hideki Higashidozono, Fujisawa; Ichiro Hirata, Fujisawa, all of (JP)

(73) Assignees: Kabushiki Kaisha Toyoda Jidoshokki Seisakusho, Kariya; NOK Corporation, Tokyo, both of (JP)

( * ) Notice: Subject to any disclaimer, the term of this patent is extended or adjusted under 35 U.S.C. 154(b) by 0 days.

(21) Appl. No.: 09/392,165

(22) Filed: Sep. 8, 1999

(30) Foreign Application Priority Data

Sep. 10, 1998 (JP) ..... 10-256577

(51) Int. Cl.[7] ..... F04B 1/26
(52) U.S. Cl. ..... 417/222.2
(58) Field of Search ..... 417/222.2

(56) References Cited

U.S. PATENT DOCUMENTS 5,145,325 A * 9/1992 Terauchi ..... 417/222.2
5,205,718 A * 4/1993 Fujisawa et al. ..... 417/222.2
5,242,274 A * 9/1993 Inoue ..... 417/222.2
5,242,275 A * 9/1993 Terauchi et al. ..... 417/222.2
5,607,286 A * 3/1997 Takenaka et al. ..... 417/222.2
5,702,235 A * 12/1997 Hirota et al. ..... 417/222.2
5,797,730 A * 8/1998 Kawaguchi et al. ..... 417/222.2
5,807,076 A * 9/1998 Kawaguchi et al. ..... 417/228
6,010,312 A 1/2000 Suitou et al. ..... 417/222.2

FOREIGN PATENT DOCUMENTS

DE 197 33 099 A1 2/1998 ..... F25B/49/02
EP 448 372 A 9/1991 ..... F04B/1/28
JP 06-26454 2/1994

* cited by examiner

*Primary Examiner*—Charles G. Freay
(74) *Attorney, Agent, or Firm*—Morgan & Finnegan, LLP

(57) ABSTRACT

A control valve is provided to be mainly used in a clutch-less compressor of the type in which displacement of the compressor is varied depending on the inclination of a drive plate which varies depending on the crank pressure. The control valve includes biasing means that applies force to a valve body, a force transferring member that urges the valve body to forcibly open the valve, and a solenoid assembly to actuate the force transferring member. The valve remains closed when no electric current is supplied to the solenoid assembly, regardless of the crank pressure or the suction pressure. This facilitates minimum displacement operation of the compressor for a desired period of time and therefore makes the valve suitable for a clutch-less type compressor that is directly connected to an engine with a belt and/or a pulley.

18 Claims, 5 Drawing Sheets

VARIABLE DISPLACEMENT COMPRESSORS AND CONTROL VALVES FOR VARIABLE DISPLACEMENT COMPRESSORS

BACKGROUND OF THE INVENTION

The present invention relates to compressors and controls valves for compressors, and more particularly, to variable displacement compressors and control valves employed in such compressors.

A typical type of variable displacement compressor employs an inclinable drive plate housed in a crank chamber. The inclination of the drive plate is changed to vary the displacement of the compressor. A control valve adjusts the pressure in the crank chamber (crank pressure Pc) to alter the inclination of the drive plate. Japanese Unexamined Patent Publication No. 6-26454 describes a compressor that employs such a control valve. The compressor has a bleeding passage that connects a crank chamber to a suction chamber (which is connected to the outlet of an evaporator). The control valve is located in the bleeding passage and includes an electromagnetic coil, a bellows, a valve body attached to the bellows, a valve chamber accommodating the bellows and the valve body, and a valve port connecting the crank chamber and the suction chamber. The target of the pressure in the suction chamber (target suction pressure) is adjusted by changing the current flowing through the electromagnetic coil. The refrigerant gas in the suction chamber is drawn into the valve chamber. The pressure of the suction chamber (suction pressure Ps) communicated to the valve chamber moves the valve body and changes the opened area of the valve port. This adjusts the amount of refrigerant gas that is released into the suction chamber from the crank chamber and thus controls the crank pressure Pc. The force of the bellows acts on the valve body to close the valve port, while the crank pressure Pc acts on the valve body to open the valve port.

In automobile air-conditioning systems, clutchless variable displacement compressors are often employed since they are lighter than compressors having clutches. A clutchless compressor is directly connected to an external drive source, or engine, by a pulley and a transmission belt without using an electromagnetic clutch. Since engine power is constantly transmitted to the compressor, the displacement of the compressor must be minimized by moving the drive plate to a minimum inclination position when the passenger compartment does not require cooling or when the cooling load is extremely small.

The control valve described in the Japanese patent publication can be employed in a clutchless variable displacement compressor. However, it is rather difficult to maintain the drive plate at the minimum inclination position and operate the compressor in a minimum displacement state. This is because the control valve must be either completely closed or minimally opened to maximize the crank pressure Pc and hold the drive plate at the minimum inclination position. Since the crank pressure Pc acts to open the control valve, it becomes difficult to keep the control valve closed or minimally opened as the crank pressure Pc increases. As a result, the crank pressure Pc cannot be increased sufficiently to hold the drive plate at the minimum inclination position and maintain minimum displacement operation. If minimum displacement cannot be continued when cooling is not necessary, engine power is consumed by the compressor in an inefficient manner. This diminishes the merits of clutchless compressors.

SUMMARY OF THE INVENTION

Accordingly, it is an objective of the present invention to provide a control valve that regulates the release of gas from a crank chamber in a clutchless variable displacement compressor. It is a further objective of the present invention to provide a clutchless variable displacement compressor that can continue minimum inclination operation as long as necessary.

To achieve the above objectives, the present invention provides a control valve for use with a compressor. The compressor is generally of the type that has a drive plate that inclines with respect to the axis of a drive shaft. The drive plate connects a piston to the drive shaft to convert rotation of the drive shaft into linear reciprocation of the piston within a cylinder bore. The compressor has a crank chamber which accommodates the drive plate. The pressure of the crank pressure is a crank pressure. The compressor also has a suction chamber into which gas is introduced from an external refrigerant circuit. The pressure of the suction chamber is a suction pressure. The compressor also includes a bleeding passage that permits flow of gas from the crank chamber to the suction chamber. Displacement of the compressor is varied depending on the inclination of the drive plate, which varies depending on the crank pressure.

In one aspect of the present invention, a control valve includes a valve chamber that forms a part of the blending passage. A valve seat defines a crank chamber side region and a suction chamber side region in the valve chamber. A valve port is formed in the valve seat to connect the two regions. A valve body engages and disengages from the valve seat to close and open the valve port, respectively. The control valve also includes a force transferring member. One of the valve body and the force transferring member is located in the crank chamber side region while the other is located in the suction chamber side region. A first spring urges the valve body toward the valve seat. A solenoid assembly generates an electromagnetic biasing force that is dependent upon the level of an electric current supplied to the solenoid assembly. The solenoid assembly urges the valve body in a direction away from the valve seat in accordance with the biasing force. The valve body remains engaged with the valve seat to close the valve port, regardless of the crank pressure or the suction pressure, when no electric current is supplied to the solenoid assembly.

This aspect of the present invention facilitates minimum displacement operation of the compressor for a desired period of time and therefore makes the valve suitable for a clutch-less type compressor that is directly connected to an engine with a belt and/or a pulley.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
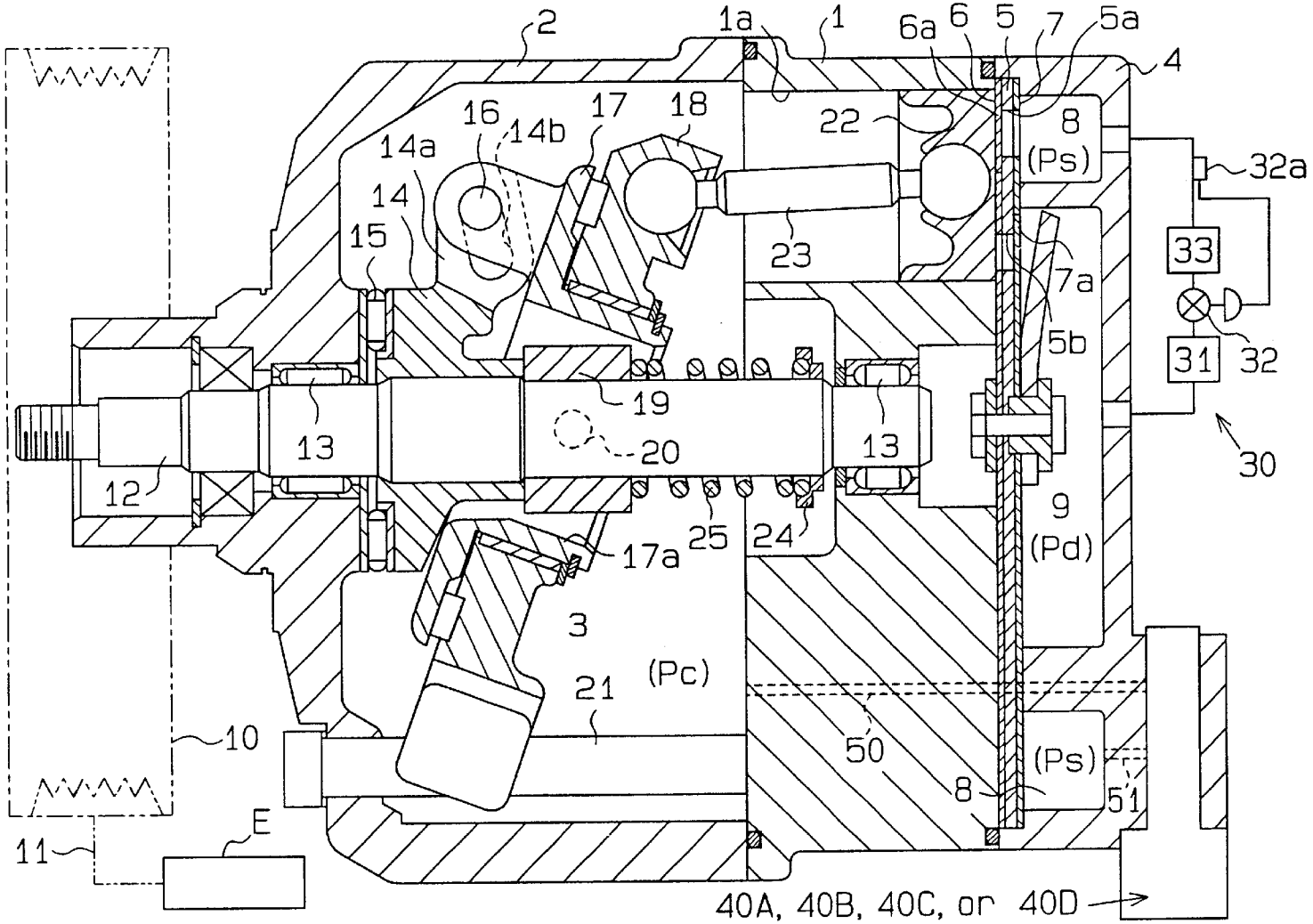
FIG. 1 is a cross-sectional view showing a variable displacement compressor to which control valves according to the present invention are applied.

Four control valves (four embodiments) for variable displacement compressors will now be described with reference to the drawings. Each control valve is employed in the compressor shown in FIG. 1. In the drawings, like numerals are used for like elements throughout.

[First Embodiment]

As shown in FIG. 1, a variable displacement compressor includes a cylinder block 1 having a plurality of cylinder bores 1*a* (only one shown). A front housing 2 is fixed to the front end of the cylinder block 1. The front housing 2 houses a crank chamber 3. A rear housing 4 is fixed to the rear end of the cylinder block 1 with a valve plate 5 arranged in between. The cylinder block 1, the front housing 2, and the rear housing 4 define a compressor housing. A suction plate 6 having suction flaps 6*a* is arranged on the front side of the valve plate 5, while a discharge plate 7 having discharge flaps 7*a* is arranged on the rear side of the valve plate 5. The central portion of the rear housing 4 houses a discharge chamber 9. A suction chamber 8 extends about the discharge chamber 9 in the peripheral portion of the rear housing 4. A suction port 5*a* and a discharge port 5*b* extend through the valve plate 5 in correspondence with each cylinder bore 1*a*. Each suction port 5*a* connects the suction chamber 8 with the associated cylinder bore 1*a*. Each cylinder bore 1*a* is connected to the discharge chamber 9 by the associated discharge port 5*b*.

A rotary shaft 12 is rotatably supported by a pair of bearings 13 in the cylinder block 1 and the front housing 2. One end of the rotary shaft 12 is directly connected to an external drive source, or engine E, by a pulley 10 and a power transmission belt 11, which are indicated by broken lines. A rotor 14 is fixed to the rotary shaft 12 in the crank chamber 3 to rotate integrally with the rotary shaft 12. A thrust bearing 15 is arranged between the rotor 14 and the inner wall of the front housing 2. A pair of arms 14*a* having elongated holes 14*b* extend from the rotor 14. A pin 16 is inserted through the elongated holes 14*b* to pivotally connect the rotor 14 to a drive plate 17, which permits the drive plate 17 to incline.

The drive plate 17 has a hub 17*a*. A sleeve 19, which slides axially along the rotary shaft 12, is connected to the inner wall of the hub 17*a* by two connecting pins 20 (only one shown in FIG. 1), which are arranged on opposite sides of the rotary shaft 12. A wobble plate 18 is fitted He to the hub 17*a* and is supported so that it is rotatable relative to the drive plate 17. A guide rod 21 extends through the crank chamber 3 to prohibit rotation of the wobble plate 18, while guiding the inclination of the wobble plate 18. A piston 22 is retained in each cylinder bore 1*a* and connected to the wobble plate 18 by a piston rod 23. A coil spring 25 is arranged on the rotary shaft 12 between the sleeve 19 and a ring 24, which is secured to the rotary shaft 12. The spring 25 biases the drive plate 17 and the wobble plate 18 in a direction that increases their inclination.

When the power transmitted from the engine E rotates the rotary shaft 12, the drive plate 17 rotates, while inclined at a certain angle, and produces undulated motion of the wobble plate 18. This causes each piston rod 23 to reciprocate the associated piston 23 with a stroke corresponding to the inclination of the drive plate 17. During the reciprocation of each piston 23, refrigerant gas is drawn into the associated cylinder bore 1*a* from the suction chamber 8, compressed, and then discharged into the discharge chamber 9 in a cyclic manner.

The drive plate 17 and the wobble plate 18 function as a drive mechanism or a swash plate. The parameters that determine the inclination of the drive plate 17 includes the moment of the centrifugal force produced during rotation of the drive plate 17, the moment of the biasing force produced by the spring 25 and the moment of the refrigerant gas pressure. The product of inertia of the drive mechanism is determined and the spring 25 is selected such that the centrifugal force moment and the spring force moment constantly act to increase the inclination of the drive plate. The refrigerant gas pressure moment refers to the moment produced by the interrelation of the compression reaction acting on the pistons 22 of the cylinder bores 1*a* undergoing the compression stroke, the interior pressure of the cylinder bores 1*a* undergoing the suction stroke, and the interior pressure of the crank chamber 3 (crank pressure Pc) acting as a back pressure applied to the pistons 22. When the crank pressure Pc is high such that the gas pressure moment (which acts to decrease the inclination of the drive mechanism) becomes greater than the moments acting to increase the inclination of the drive plate 17 (i.e., the centrifugal force moment and the spring force moment), the drive plate 17 moves to the minimum inclination position (e.g., the position where the angle between a plane perpendicular to the rotary shaft 12 and the drive plate 17 is 3° to 5°). The drive plate 17 can also be arranged at an arbitrary inclination angle between the minimum and maximum inclination angles by decreasing the crank pressure Pc and balancing the gas pressure moment with the centrifugal force and spring force moments. The crank pressure Pc is controlled to alter the inclination of the drive plate 17 in order to change the stroke of the pistons 22 and vary the displacement of the compressor.

Figure 2:
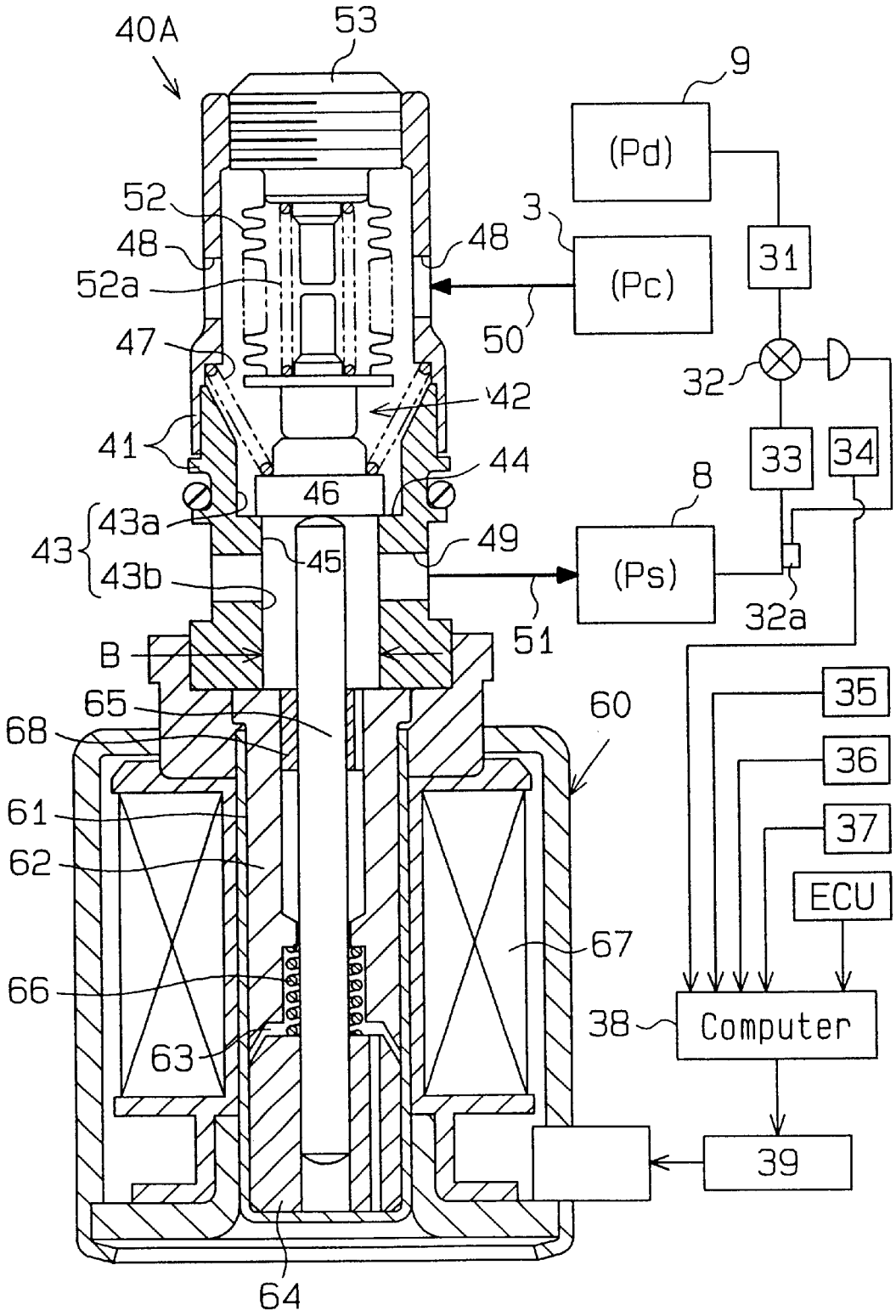
FIG. 2 is a cross-sectional view showing a control valve according to the first embodiment.

As shown in FIGS. 1 and 2, the discharge chamber 9 and the suction chamber 8 are connected to each other through an external refrigerant circuit 30. The external refrigerant circuit 30 and the compressor forms a cooling circuit of an automobile air-conditioning system. The external refrigerant circuit 30 includes a condenser 31, an expansion valve 32, and an evaporator 33. A temperature detector 32*a* is located at the outlet of the evaporator 33. The expansion valve 32 functions as a variable throttling element located between the condenser 31 and the evaporator 33. In other words, the opening size of the expansion valve 32 is feedback controlled in accordance with the temperature detected by the temperature detector 32*a* and the vaporizing pressure (i.e., the pressure at the inlet or outlet of the evaporator 33). The expansion valve 32 functions to produce a difference between the pressure of the condenser 31 and that of the evaporator 33 and supplies the evaporator 33 with liquefied refrigerant, the amount of which corresponds to the thermal load. This adjusts the amount of refrigerant flowing through the external refrigerant circuit 30 such that the refrigerant is superheated to an appropriate level by the evaporator 33.

As shown in FIG. 2, a further temperature sensor 34 is arranged in the vicinity of the evaporator 33. The temperature sensor 34 detects the temperature of the evaporator 33 and sends evaporator temperature data to a computer 38, which controls the air-conditioning system. In addition to the temperature sensor 34, a passenger compartment temperature sensor 35 for detecting the temperature of the passenger compartment, a temperature adjustor 36 for setting the temperature of the passenger compartment, an air-conditioner switch 37 for actuating the air-conditioning system, and an electronic control unit (ECU) for electronically controlling the engine E are connected to the input side of the computer 38. The output side of the computer 38 is connected to a drive circuit 39 which is used to energize a coil 67 of a control valve 40A (described later).

The computer 38 computes a current I for energizing the coil 67 based on external data, such as the evaporator temperature detected by the temperature sensor 34, the passenger compartment temperature detected by the passenger compartment temperature sensor 35, the desired passenger compartment temperature set by the temperature adjustor 36, the ON/OFF state of the air-conditioner switch 37, and information sent from the ECU that is related the engine E (i.e., whether the engine is running and the engine speed). The drive circuit 39 then receives a command from the computer 38 to supply the control valve 40A with the current I to energize the coil 67 and adjust the opening size of the control valve 40A.

The structure of the control valve 40A, which adjusts the amount of refrigerant gas released from the crank chamber 3 to control the crank chamber Pc, will now be described with reference to FIG. 2. In the compressor of FIG. 1, refrigerant gas enters the crank chamber 3 through the slight space between each piston 22 and the wall of the associated cylinder bore 1*a*. This gas is referred to as blowby gas. That is, blowby gas leaks into the crank chamber 3 through the space between the piston 22 undergoing the compression stroke and the wall of the associated cylinder bore 1*a*.

The control valve 40A includes a valve mechanism 42, which is housed in a valve housing 41, and a solenoid 60, which is coupled to the housing 41. A valve chamber 43 is defined in the valve housing 41.

An annular valve seat 44 extends along the inner wall of the valve housing 41 at a mid-section of the valve chamber 43. In the valve chamber 43, an upper region (crank chamber side region) 43*a* is defined above the valve seat 44 and a lower region (suction chamber side region) 43*b* is defined below the valve seat 44. A valve port 45 connecting the upper and lower regions extends through the center of the valve seat 44.

An entrance port 48 extends through the wall of the at valve housing 41 at the upper region 43*a* of the valve chamber 43. An exit port 49 extends through the wall of the valve housing 41 at the lower region 43*b* of the valve chamber 43. A passage 50 extending through the compressor is connected with the entrance port 48. The passage 50 connects the crank chamber 3 to the upper region 43*a*. A further passage 51 extending through the compressor is connected with the exit port 49. The passage 51 connects the lower region 43*b* to the suction chamber 8. Accordingly, a bleeding passage is defined between the crank chamber 3 and the suction chamber 8 by the passage 50, the entrance port 48, the valve chamber 43, the exit port 49, and the passage 51.

A valve element 46 is retained in the upper region 43*a* of the valve chamber 43. The valve element 46 is movable in the axial direction (vertical direction of the control valve 40A in FIG. 2) such that it moves toward or away from the valve seat 44. When the valve element 46 contacting the valve seat 44, the valve element 46 closes the valve port 45 and disconnects the upper region 43*a* from the lower region 43*b*. The valve element 46 is cylindrical and has a step formed on its outer surface. A spring 47 is held between the step on the valve element 46 and a step formed on the inner wall of the valve housing 41. The spring 47 constantly biases the valve element 46 toward the valve seat 44 (i.e., in a direction closing the valve port 45).

A bellows 52, or pressure sensitive membrane device, is arranged in the upper region 43*a* of the valve chamber 43. The effective area A of the bellows 52 is equal to the opening area B of the lower region 43*b* (A=B). The effective area A of the bellows 52 is the area that is effective in applying a net force to the bellows 52 as a result of the net pressure applied to the bellows 52. An adjustor 53 is screwed into the top portion of the valve housing 41. The upper end of the bellows 52 is fixed to the adjustor 53.

The interior of the bellows 52 is in a vacuum, or is depressurized, and accommodates a spring 52*a*. The spring 52*a* biases the lower end of the bellows 52 downward. The refrigerant gas in the crank chamber 3 is drawn into the upper region 43*a* of the valve chamber 43 through the passage 50 and the entrance port 48. Thus, the lower, movable end of the bellows 52 abuts against or moves away from the valve element 46 depending on the level of the crank pressure Pc. The location of the valve element 46 in the valve chamber 43 determines the opening size of the control valve 40A (i.e., the opening size of the bleeding passage).

The solenoid 60, which forms the lower part of the control valve 40A, has a cup-like retainer 61. A fixed steel core 62 is fitted into the upper portion of the retainer 61. The fixed core 62 defines a solenoid chamber 63 in the retainer 61. A movable steel core 64, which serves as a plunger, moves axially in the solenoid chamber 63.

A solenoid rod 65, or force transferring member, extends through the center of the fixed core 62. A bearing 68 is arranged between the fixed core 62 and the solenoid rod 65 so that the rod 65 is movable in the axial direction. A passage extends along the bearing 68 to equalize the pressures at the upper and lower sides of the bearing 68.

The upper end of the solenoid rod 65 is located in the lower region 43*b* of the valve chamber 43, to which the pressure of the suction chamber 8 (suction pressure Ps) is applied. The lower end of the solenoid rod 65 is located in the solenoid chamber 63 and fitted into a bore extending through the center of the movable core 64. The movable core 64 and the solenoid rod 65 are fixed to each other. Thus, the movable core 64 and the solenoid rod 65 move integrally with each other in the axial direction. A spring 66 is arranged between the movable core 64 and the fixed core 62. The spring 66 biases the movable core 64 and the solenoid rod 65 in the downward direction of FIG. 2.

A coil 67 is wound about the fixed and movable cores 62, 64. The computer 38 commands the drive circuit 39 so that current I flows through the coil 67. This causes the coil 67 to produce an electromagnetic force corresponding to the current I. The electromagnetic force attracts the movable core 64 toward the fixed core 62 and moves the solenoid rod 65 away from the solenoid 60 in the axial direction. This, in turn, pushes the valve element 46 away from the solenoid 60. The opening size of the control valve 40A is determined by the distance between the valve element 46 and the valve seat 44.

If the air-conditioner switch 37 is ON when the engine E is running, the computer 38 obtains the temperature of the evaporator detected by the temperature sensor 34 and the difference between the passenger compartment temperature detected by the passenger compartment temperature sensor 35 and the temperature set by the temperature adjustor 36. The computer 38 then uses this data to compute the current I for energizing the coil 67 using a formula, which is predetermined by a control program. The drive circuit 39 is then commanded to energize the coil 67 in accordance with the computed current I. This produces an electromagnetic attraction, or upward biasing force F of the solenoid rod 65. The biasing force F determines the opening size of the control valve 40A and controls the crank pressure Pc and the suction pressure Ps.

The control valve 40A serves to control the inclination of the drive plate by adjusting the crank pressure Pc. More specifically, if the coil 67 is energized to open the control valve 40A, the gas in the crank chamber 3 is drawn into the suction chamber 8 through the bleeding passage. If the amount of blowby gas entering the crank chamber 3 becomes less than the amount of refrigerant gas flowing through the bleeding passage from the crank chamber 3 to the suction chamber 8, the crank pressure Pc decreases. This increases the inclination of the drive plate 17. If the amount of blowby gas entering the crank chamber 3 becomes greater than the amount of refrigerant gas flowing through the bleeding passage from the crank chamber 3 to the suction chamber 8, the crank pressure Pc increases. This decreases the inclination of the drive plate 17. If the amount of refrigerant gas entering the crank chamber 3 becomes equal to that leaving the crank chamber 3, the crank pressure Pc becomes constant, which holds the drive plate 17 at its current inclination.

The control valve 40A also serves to control the suction pressure Ps without influence from the crank pressure Pc.

The downward biasing force of the bellows 52 (including the spring 52*a*) is represented by $f_0$, the downward biasing force of the spring 47 is represented by $f_1$, the downward biasing force of the spring 66 is represented by $f_2$, and the electromagnetic attraction of the movable core 64 generated when the coil 67 is energized (i.e., the upward biasing force of the solenoid rod 65) is represented by F. As described above, the effective area of the bellows 52 is represented by A and the opening area of the lower region 43*b* of the valve chamber 43 is represented by B.

The biasing force applied to the valve element 46 by the solenoid 60 in the valve opening (upward) direction is represented by $(F-f_2)$. The biasing force applied to the valve element 46 by the valve mechanism 42 in the valve closing (downward) direction is represented by $(f_0-Pc\times A+f_1)$. The biasing force applied to the valve element 46 by the difference between the pressures of the upper and lower regions 43*a*, 43*b* of the valve chamber 43 is represented by (Pc−Ps)B. The relationship between the three biasing forces is indicated by equation (1). Equation (2) is derived from equation (1).

$$F-f_2=f_0-Pc\times A+f_1+(Pc-Ps)B \quad (1)$$

$$PsB=f_0+f_1+f_2-F+Pc(B-A) \quad (2)$$

The effective area A is equal to the opening area B. Thus, the suction pressure Ps can be represented as indicated by equation (3), which is derived from equation (2).

$$Ps=(f_0+f_1+f_2-F)/B \quad (3)$$

In equation (3), the biasing forces $f_0$, $f_1$, and $f_2$ are predetermined constants and the biasing force F is a function of the current I for energizing the coil 67. Thus, the suction pressure Ps varies in accordance with the current I of the coil 67 and is not affected by the crank pressure Pc. The biasing force $f_0$ of the bellows 52 can be changed by adjusting the position of the adjustor 53.

The computer 38 computes the current I for energizing the coil 67 based on the input data to control the opening size of the control valve 40A. This adjusts the inclination of the drive plate and varies the displacement of the compressor. Furthermore, the pressure of the suction chamber 8 (suction pressure Ps), which is substantially the same as the outlet pressure Ps' of the evaporator 33, is adjusted and maintained at a value close to the target suction pressure Pset. Thus, the control valve 40A and the computer 38 vary the displacement of the compressor such that the outlet pressure Ps' of the evaporator 33, which reflects the cooling load, is stabilized at a value close to the target suction pressure Pset. The solenoid 60 of the control valve 40A and the computer 38 function to control the opening of the control valve 40A such that the suction pressure Ps becomes substantially the same as the target suction pressure Pset. Furthermore, the solenoid 60 and the computer 38 change the target suction pressure Pset by controlling the current I for energizing the coil 67.

If the air-conditioner switch 37 is OFF when the engine E is running or if the cooling load is small when the switch 37 is ON, the computer 38 controls the drive circuit 39 to stop energizing the coil 67. This eliminates the electromagnetic attraction between the cores 62, 64 and nullifies the upward biasing force F of the solenoid rod (F=0). As a result, the downward biasing force $f_2$ of the spring 66 in the solenoid 60 moves the movable core 64 and the solenoid rod 65 downward and separates the upper end of the solenoid rod 65 from the valve element 46. In this state, the biasing force $f_1$ of the spring 47 and the biasing force (Pc−Ps) B of the differential pressure between the upper and lower regions 43*a*, 43*b* of the valve chamber 43 cause the valve element 46 to contact the valve seat 44.

If the crank pressure Pc is greater than the biasing force $f_0$ of the bellows 52 ($f_0 \leqq Pc\times A$) when cooling is not required (the Coil 67 being de-energized), the movable lower end of the bellows 52 separates from the valve element 46 and thus does not bias the valve element 46. On the other hand, if the biasing force $f_0$ of the bellows 52 is greater than the crank pressure Pc ($f_0>Pc\times A$) when cooling is not required, the lower end of the bellows 52 biases the valve element 46 in the direction that closes the control valve 40A. In each case, the crank pressure Pc does not act to bias the valve element 46 in the direction opening the control valve 40A and the valve element 46 is kept in contact with the valve seat 44. Thus, the valve 40A is completely closed and the flow of refrigerant gas in the bleeding passage from the crank chamber 3 to the suction chamber 8 is stopped. This causes the blowby gas to increase the crank pressure Pc and move the drive plate 17 to the minimum inclination position.

The advantages of the first embodiment will now be described.

The valve element 46 is kept in contact with the valve seat 44 and is unaffected by the crank pressure PC and the suction pressure Ps when the coil 67 of the solenoid 60 is not energized. Since the control valve 40A remains closed when the air-conditioner switch 37 is OFF or when the cooling load is small, the crank pressure Pc increases and holds the drive plate 17 at the minimum inclination position. Thus, the compressor can perform minimum displacement operation continuously. Accordingly, the control valve 40A is optimal for employment in a clutchless type variable displacement compressor such as that shown in FIG. 1.

In the control valve 40A, the effective area A of the bellows 52 is equal to the opening area B. This causes the current I flowing through the coal to directly determine the suction pressure Ps. Therefore, the target suction pressure Pset may be selected from a range that corresponds to the controllable range of the current I ($I_{min}$ to $I_{max}$). Accordingly, the target suction pressure Pset can be selected from a relatively wide range when controlling the control valve 40A.

[Second Embodiment]

Figure 3:
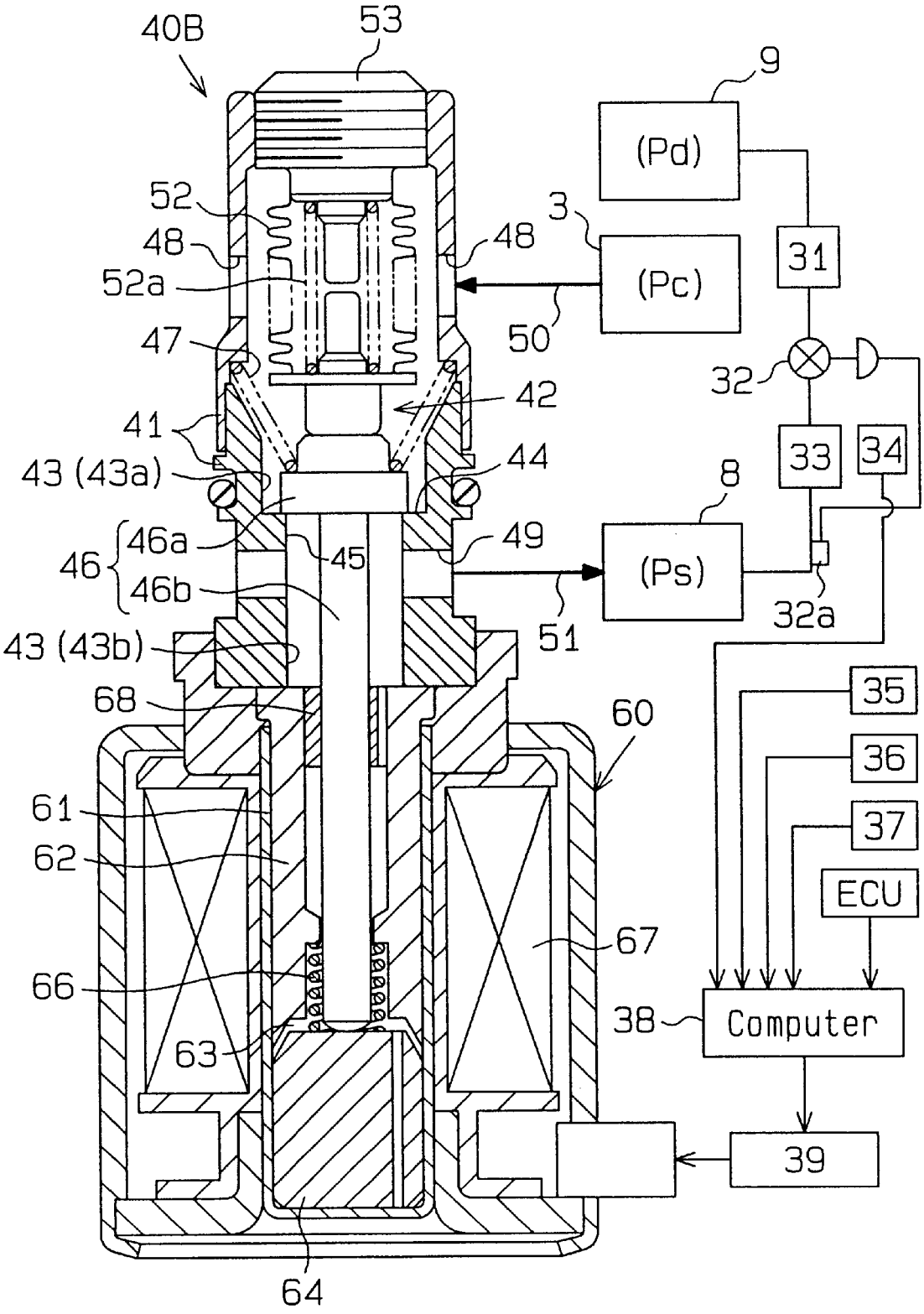
FIG. 3 is a cross-sectional view showing a control valve according to the second embodiment.

A control valve 40B according to a second embodiment of the present invention will now be described with reference to FIG. 3. The valve element, the solenoid rod, and the movable core employed in the control valve 40B of FIG. 3 differ from those of the control valve 40A of FIG. 2.

In the control valve 40A of FIG. 2, the valve element 46 and the solenoid rod 65 are separate, and the solenoid rod 65 and the movable core 64 are integrally joined with each other. However, in the control valve 40B of FIG. 3, a valve element 46*a* and a solenoid rod 46*b* are integrally formed, and the movable core 64 is separate from the rod 46*b*.

The control valve 40B of the second embodiment has the same advantages as the control valve 40A of the first embodiment.

[Third Embodiment]

A control valve 40C according to the present invention will now be described with reference to FIG. 4. Although the control valve 40C includes a valve mechanism 42 and a solenoid 60 like the control valve 40A of FIG. 2, the structure of the valve mechanism 42 differs from that of the control valve 40A.

Figure 4:
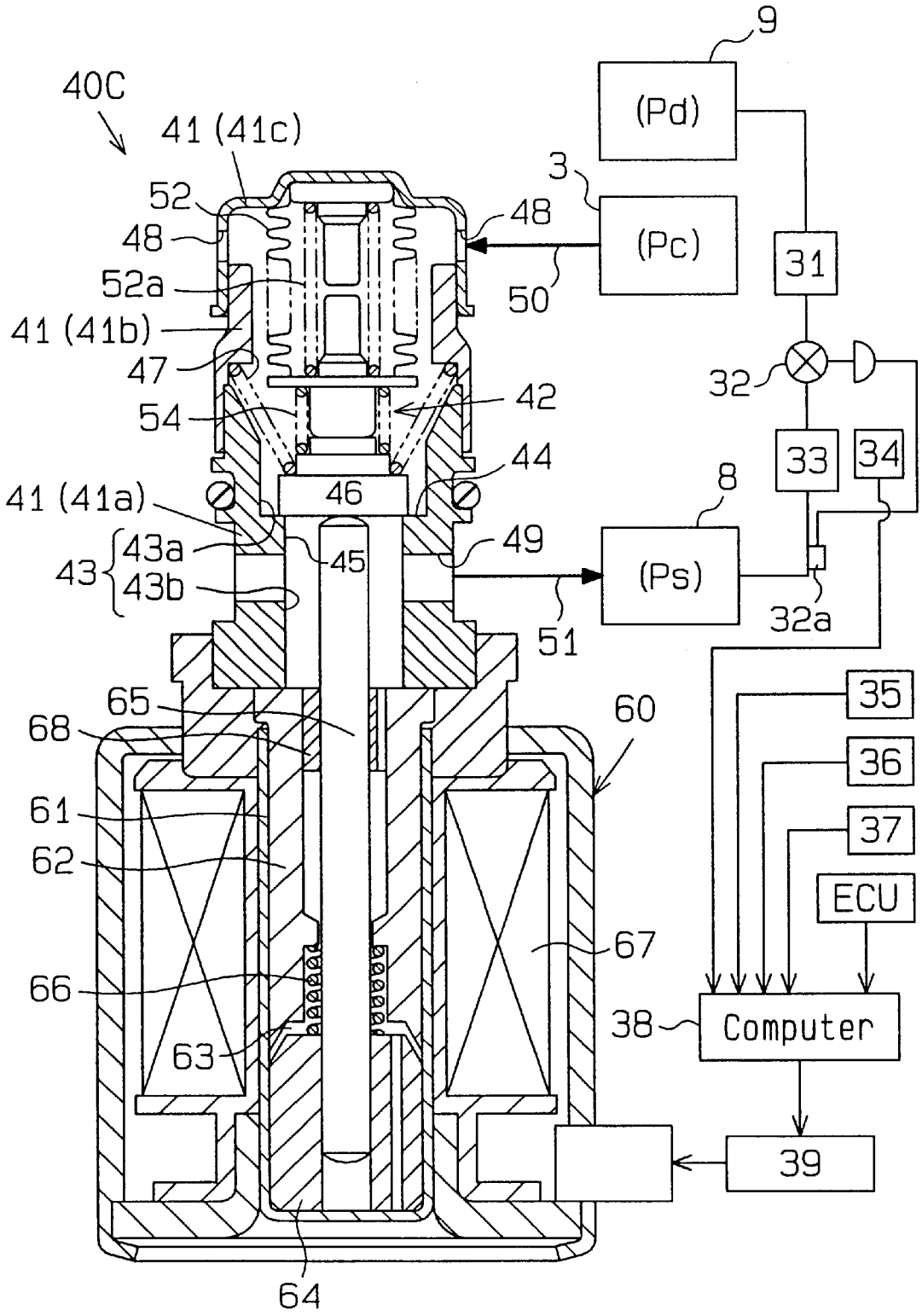
FIG. 4 is a cross-sectional view showing a control valve according to the third embodiment.

In the control valve 40C of FIG. 4 the valve mechanism 42 includes a valve housing 41, which is defined by a main body 41*a*, a generally cylindrical first cover 41*b* located a above the main body 41*a*, and a cap-like second cover 41*c* located above the first cover 41*b*. The valve housing 41 houses a valve chamber 43. A valve seat 44 extends along the wall of the middle portion of the valve chamber 43. An upper region (crank chamber side region) 43*a* is defined above the valve seat 44 in the valve chamber 43, and a lower region (suction chamber side region) 43*b* is defined below the valve seat 44 in the valve chamber 43.

An entrance port 48 extends through the peripheral wall of the second cover 41*c* from the upper region 43*a* of the valve chamber 43. A passage 50 extending through the compressor is connected with the entrance port 48. The passage 50 connects the upper region 43*a* to the crank chamber 3. An exit port 49 extends through the peripheral wall of the main body 41*a*. A passage 51 extending through the compressor is connected with the exit port 49. The passage 51 connects the lower region 43*b* to the suction chamber 8. Accordingly, a bleeding passage is defined between the crank chamber 3 and the suction chamber 8 by the passage 50, the entrance port 48, the valve chamber 43, the exit port 49, and the passage 51.

A valve element 46 is retained in the upper region 43*a* of the valve chamber 43. The valve element 46 is movable in the axial direction (vertical direction of the control valve 40C) toward or away from the valve seat 44. When the valve element 46 contacts the valve seat 44, the valve element 46 closes the valve port 45 and disconnects the upper region 43*a* from the lower region 43*b*. The valve element 46 is cylindrical but has an upper step and a lower step. A spring 47 is held between the lower step and a step formed on the inner wall of the first cover 41*b*. The spring 47 constantly biases the valve element 46 toward the valve seat 44 (i.e., in a direction closing the valve port 45).

A bellows 52 is arranged in the upper region 43*a* of the valve chamber 43. The effective area A of the bellows 52 is equal to the opening area B of the lower region 43*b* (A=B). As shown in FIG. 4, the upper end of the bellows 52 is engaged with an indentation formed in the top part of the second cover 41*c*. A spring 54 is arranged between the lower end of the bellows 52 and the upper step of the valve element 46. The bellows 52 is pressed against the second cover 41*c* and is held between the second cover 41*c* and the valve element 46. Thus, the upper end of the bellows 52 is fixed, and the lower end of the bellows 52 is movable.

The interior of the bellows 52 is in a vacuum, or is depressurized, and accommodates a spring 52*a*. The spring 52*a* biases the lower movable end of the bellows 52 axially toward the valve element 46. Refrigerant gas is drawn into the upper region 43*a* of the valve chamber 43 through the passage 50 and the entrance port 48. Thus, the bellows 52 expands and presses against the valve element 46 or contracts and separates from the valve element 46 depending on the crank pressure Pc. The opening size of the control valve 40C (i.e., the opening size of the bleeding passage) is adjusted in accordance with the location of the valve element 46 in the valve chamber 43. The pressure of the suction chamber 8 (suction pressure Ps) is applied to the lower region 43*b* of the valve chamber 43.

The control valve 40C, which is used in the compressor of FIG. 1, functions in the same manner as the control valve 40A of the first embodiment. If the air-conditioner switch 37 is ON when the engine E is running, the computer 38 energizes the coil 67 to adjust the opening size of the control valve 40C. This determines the inclination of the drive plate 17, the compressor displacement, and the suction pressure Ps. The spring 54 functions as part of the bellows 52. Thus, the downward biasing force $f_0$ of the bellows 52 includes the force of the springs 54 and 52*a*. Accordingly, equations (1) to (3) are also applied to the control valve 40C of FIG. 4. Thus, the suction pressure Ps is determined by the current I that energizes the coil 67 without influence from the crank pressure Pc.

If the air-conditioner switch 37 is OFF when the engine E is running or if the cooling load is small when the air-conditioner switch is ON, the computer 38 stops the flow of current to the coil 67. This permits the spring 66 to move the movable core 64 and the solenoid rod 65 downward and separates the upper end of the solenoid rod 65 from the valve element 46. As a result, the biasing force $f_1$ of the spring 47 and the biasing force (Pc−Ps) B produced by the differential pressure between the upper and lower regions 43*a*, 43*b* of the valve chamber 43 are applied to the valve element 46, which causes the valve element 46 to contact the valve seat 44. The crank pressure Pc does not act to move the valve element 46 in a direction opening the control valve 40C. Thus, the control valve 40C is fully closed which prevents the flow of refrigerant gas through the bleeding passage from the crank chamber 3 to the suction chamber 8. As a result, blowby gas increases the crank pressure Pc and moves the drive plate 17 toward the minimum inclination position. Accordingly, the control valve 40C of FIG. 4 has the same advantages as the control valve 40A of FIG. 2.

[Fourth Embodiment]

Figure 5:
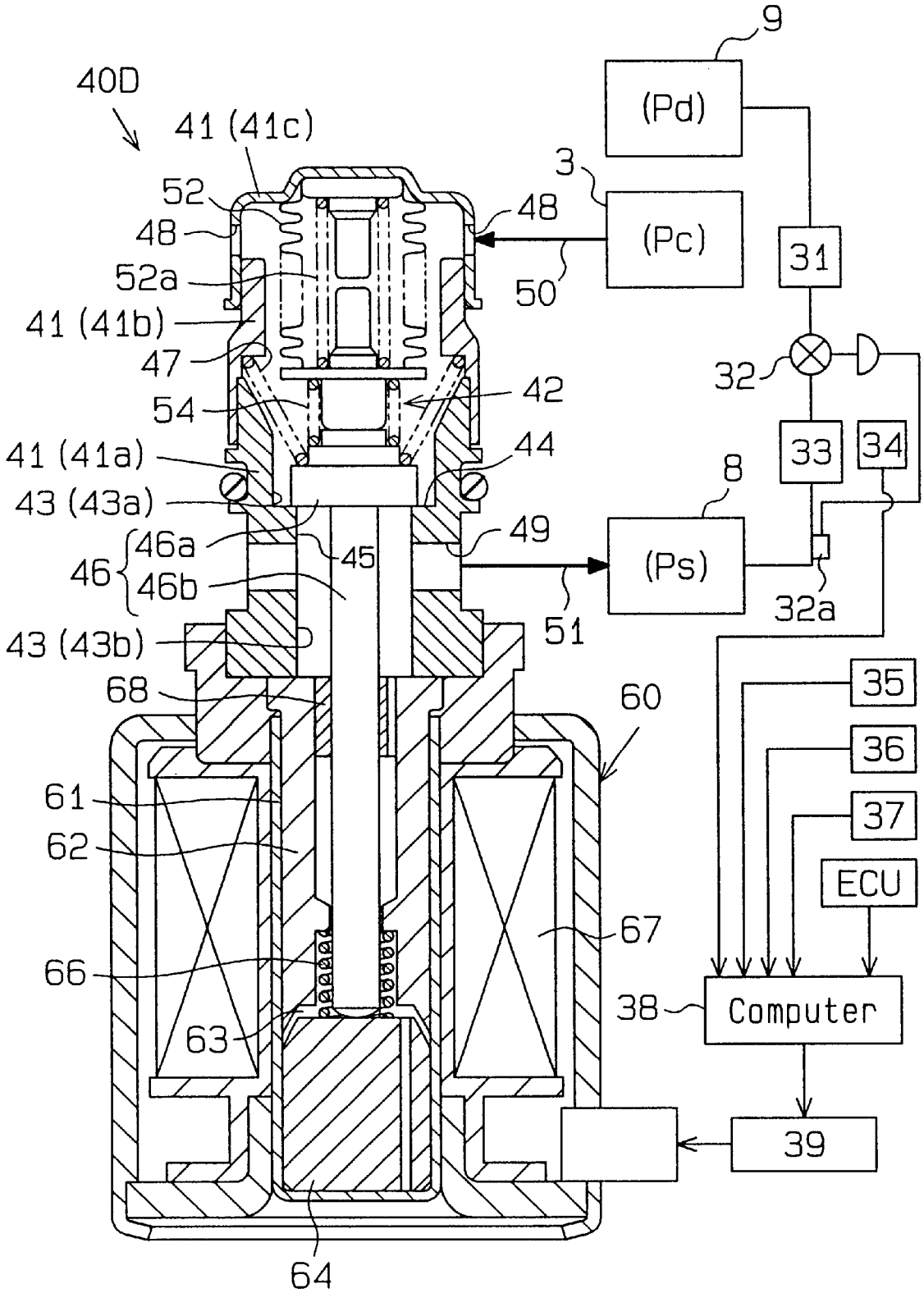
FIG. 5 is a cross-sectional view showing a control valve according to the fourth embodiment.

A control valve 40D according to a fourth embodiment of the present invention will now be described with reference to FIG. 5. The valve body, the solenoid rod, and the movable core differ from those of the control valve 40C of FIG. 4.

In the control valve 40C of FIG. 4, the valve element 46 and the solenoid rod 65 are separate, and the solenoid rod 65 and the movable core 64 are integrally joined with each other. However, in the control valve 40D of FIG. 5, a valve element 46*a* and a solenoid rod 46*b* are integrally formed. Furthermore, the solenoid rod 46*b* and the movable core 64 are separate as in the embodiment of FIG. 3.

Although the structure of the control valve 40D differs from that of the control valve 40C, the control valves 40C, 40D have substantially the same advantages.

It should be apparent to those skilled in the art that the present invention may be embodied in many other specific forms without departing from the spirit or scope of the invention. Particularly, it should be understood that the present invention may be embodied in the following forms.

A bellows 52 is employed in each of the above embodiments. However, the bellows 52 may be replaced by a diaphragm.

Each of the control valves 40A–40D may be employed in a compressor that uses a clutch to transmit the power of an external drive source to the compressor.

The present invention may be employed in a compressor that uses a swash plate or an inclined cam plate as the drive plate.

The present examples and embodiments are to be considered as illustrative and not restrictive, and the invention is not to be limited to the details given herein, but may be modified within the scope and equivalence of the appended claims.

What is claimed is:

1. A control valve for a compressor, wherein the compressor has a drive plate that inclines with respect to the axis of a drive shaft, the drive plate connecting a piston to the drive shaft to convert rotation of the drive shaft into linear reciprocation of the piston within a cylinder bore, a crank chamber accommodating the drive plate, the pressure, a suction chamber into which gas is introduced from an external refrigerant circuit, the pressure of the suction chamber being a suction pressure, a bleeding passage permitting flow of gas from the crank chamber to the suction chamber, wherein displacement of the compressor is varied depending on the inclination of the drive plate, which varies depending on the crank pressure, the control valve comprising:

a valve chamber forming a part of the bleeding passage;

a valve seat defining a crank chamber side region and a suction chamber side region in the valve chamber;

a valve port formed in the valve seat to connect the two regions;

a valve body engaging and disengaging from the valve seat to close and open the value port, respectively;

a solenoid rod, wherein either the valve body or the solenoid rod is located in the crank chamber side region;

a first spring for urging the valve body toward the valve seat;

a solenoid assembly generating an electromagnetic biasing force that is dependent upon the level of an electric current supplied to the solenoid assembly, wherein the solenoid assembly urges the valve body via the solenoid rod in a direction away from the valve seat in accordance with the biasing force;

wherein the valve body remains engaged with the valve seat to close the valve port, regardless of the crank pressure or the suction pressure, when no electric current is supplied to the solenoid assembly, and the valve body and the solenoid rod are located in the crank chamber side region and the suction chamber side region, respectively; and wherein the control valve further comprises a pressure sensitive device that is located in the crank chamber side region of the valve chamber and engages and disengages from the valve body, wherein the pressure sensitive device urges the valve body toward the valve seat such that the pressure sensitive device, the first spring, the valve body, the solenoid rod and the solenoid assembly are connected to one another.

2. The control valve according to claim 1, wherein the pressure sensitive device has the same effective area as that of an opening of the valve port in the suction chamber side region.

3. The control valve according to claim 1, wherein the pressure sensitive device is a bellows.

4. The control valve according to claim 2, wherein the pressure sensitive device is a bellows.

5. The control valve according to claim 3, wherein the solenoid assembly comprises a coil, a movable core for urging the solenoid rod in accordance with the electromagnetic force generated by the coil, and a second spring for biasing the movable core against the force of the movable core.

6. The control valve according to claim 4, wherein the solenoid assembly comprises a coil, a movable core for urging the solenoid rod in accordance with the electromagnetic force generated by the coil, and a second spring for biasing the movable core against the force of the movable core.

7. The control valve according to claim 6, wherein the movable core is integrally formed with the solenoid rod.

8. The control valve according to claim 6, wherein the valve body is integrally formed with the solenoid rod.

9. The control valve according to claim 1, wherein the compressor is directly connected to an engine with a pulley and a belt, such that the compressor is driven at all times that the engine is running.

10. A compressor comprising:

a cylinder block having a cylinder bore;

a piston;

a drive shaft;

a drive plate that inclines with respect to the axis of the drive shaft, the drive plate connecting the piston and the drive shaft such that rotation of the drive shaft is converted into linear reciprocation of the piston in the cylinder bore, wherein the displacement of the compressor is varied depending on the stroke of the piston, which varies depending on the inclination of the drive plate;

a crank chamber accommodating the drive plate, the pressure of the crank chamber being a crank pressure;

a suction chamber for receiving gas from an external refrigerant circuit, the pressure of the suction chamber being a suction pressure;

a bleeding passage permitting flow of gas from the crank chamber to the suction chamber;

a control valve including:

a valve chamber forming a part of the bleeding passage;

a valve seat located in the valve chamber, the valve seat defining a crank chamber side region and a suction chamber side region in the valve chamber;

a valve port formed in the valve seat to connect the two regions of the valve chamber;

a valve body that engages and disengages from the valve seat to close and open the valve port, respectively;

a solenoid rod wherein either the valve body or is located in the crank chamber side region;

a first biasing means for biasing the valve body toward the valve seat;

an actuator means that is activated and deactivated in response to a signal, the actuator means generating a biasing force in accordance with the signal when activated, which urges the valve body via the solenoid rod in a direction away from the valve seat;

wherein the valve body remains engaged with the valve seat to close the valve, regardless of the crank pressure or the suction pressure, while the actuator means is deactivated, and the valve body and the solenoid rod are located in the crank chamber side region and the suction chamber side region, respectively; and wherein the control valve further includes a pressure sensitive device that is located in the crank chamber side region of the valve chamber and engages and disengages from the valve body, wherein the pressure sensitive device urges the valve body toward the valve seat in accordance with the crank pressure, such that the pressure sensitive device, the first biasing means, the valve body, the toward the valve seat in accordance with the crank pressure, such that the pressure sensitive device, the first biasing means, the valve body, the solenoid rod, and the actuator means are connected to one another.

11. The compressor according to claim 10, wherein the pressure sensitive device of the control valve has the same effective area as that of an opening of the valve port in the suction chamber side region.

12. The compressor according to claim 10, wherein the pressure sensitive device is a bellows.

13. The compressor according to claim 11, wherein the pressure sensitive device is a bellows.

14. The compressor according to claim 12, wherein the signal is a variable electric current and wherein the actuator means of the control valve includes a coil that generates an electromagnetic force based on the level of the electric current, a movable core that urges the solenoid rod in accordance with the electromagnetic force, and a second biasing means for biasing the movable core against the force of the movable core.

15. The compressor according to claim 13, wherein the signal is a variable electric current and the actuator means of the control valve includes a coil that generates an electromagnetic force based on the level of the electric current, a movable core that urges the solenoid rod in accordance with the electromagnetic force, and a second biasing means for biasing the movable core against the force of the movable core.

16. The compressor according to claim 15, wherein the movable core of the actuator means is integrally formed with the solenoid rod.

17. The compressor according to claim 15, wherein the valve body of the control valve is integrally formed with the solenoid rod.

18. The compressor according to claim 14, wherein the compressor is directly connected to an engine with a pulley and a belt, such that the compressor is driven at all times that the engine is running.

* * * * *

UNITED STATES PATENT AND TRADEMARK OFFICE

CERTIFICATE OF CORRECTION

PATENT NO. : 6,398,516 B1
DATED : June 4, 2002
INVENTOR(S) : Kawaguchi et al.

It is certified that error appears in the above-identified patent and that said Letters Patent is hereby corrected as shown below:

Column 14,
Line 21, please delete “claim 14” and insert therefor -- claim 10 --.

Signed and Sealed this

Twenty-first Day of January, 2003

JAMES E. ROGAN
*Director of the United States Patent and Trademark Office*